US011313615B2

(12) United States Patent
Park et al.

(10) Patent No.: US 11,313,615 B2
(45) Date of Patent: Apr. 26, 2022

(54) REFRIGERATOR

(71) Applicant: SAMSUNG ELECTRONICS CO., LTD., Suwon-si (KR)

(72) Inventors: Sang Min Park, Suwon-si (KR); Juno Kwon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 298 days.

(21) Appl. No.: 16/715,601

(22) Filed: Dec. 16, 2019

(65) Prior Publication Data

US 2020/0191470 A1 Jun. 18, 2020

(30) Foreign Application Priority Data

Dec. 17, 2018 (KR) ..... 10-2018-0162947

(51) Int. Cl.
*F25D 23/12* (2006.01)
*F25D 23/02* (2006.01)
*F25C 5/20* (2018.01)

(52) U.S. Cl.
CPC ..... *F25D 23/126* (2013.01); *F25C 5/22* (2018.01); *F25D 23/028* (2013.01); *F25D 2323/021* (2013.01); *F25D 2500/02* (2013.01)

(58) Field of Classification Search
CPC ..... F25C 5/22; F25D 2323/021; F25D 2323/121; F25D 23/028; F25D 23/126; F25D 2500/02; A61K 2039/55566; A61K 39/39; A61K 47/10; A61K 47/12; A61K 47/18; A61K 47/44; A61K 9/107
See application file for complete search history.

(56) References Cited

U.S. PATENT DOCUMENTS 7,228,701 B2 6/2007 Kim
7,645,965 B2 * 1/2010 Park ..... H05B 6/804 219/679
9,297,574 B2 3/2016 Lee et al.
(Continued)

FOREIGN PATENT DOCUMENTS

JP 2010-96410 4/2010
KR 10-2007-0009937 1/2007
(Continued)

OTHER PUBLICATIONS

International Search report dated Apr. 21, 2020, in corresponding International Application No. PCT/KR2019/017864.
(Continued)

*Primary Examiner* — Filip Zec
(74) *Attorney, Agent, or Firm* — Staas & Halsey LLP

(57) ABSTRACT

Disclosed is a refrigerator having an improved rear structure of a door. The refrigerator includes a main body including a storage compartment, a door rotatably coupled to the main body to open and close the storage compartment, a dispenser provided on a front surface of the door, a case mounted on a rear surface of the door and accommodating a water tank disposed adjacent to the dispenser to store water supplied to the dispenser, and a filter including a filter body disposed below the water tank in a transverse direction, and a filter handle configured to allow the filter body to be inserted or withdrawn through an inner side surface of the door from the inside of the case.

20 Claims, 10 Drawing Sheets

(56) References Cited

U.S. PATENT DOCUMENTS

| | | | | |
|---|---|---|---|---|
| 10,254,035 | B2 * | 4/2019 | Yun | F25D 17/062 |
| 2012/0304679 | A1 | 12/2012 | Krause et al. | |
| 2013/0015753 | A1 * | 1/2013 | Son | B01D 46/00 312/405 |
| 2018/0335246 | A1 | 11/2018 | Jeong et al. | |

FOREIGN PATENT DOCUMENTS

| | | |
|---|---|---|
| KR | 10-2010-0102048 | 9/2010 |
| KR | 10-2011-0072369 | 6/2011 |
| KR | 10-2012-0006353 | 1/2012 |
| KR | 10-2015-0082040 | 7/2015 |
| KR | 10-2015-0107232 A | 9/2015 |

OTHER PUBLICATIONS

Lg Usa Home Appliances And Electronics: "LG Refrigerator—How to Change the Water Filter (4 Door-French Door)", Aug. 22, 2018 (Aug. 22, 2018), XP55870327.

European Search Report dated Dec. 17, 2021 in European Application No. EP 19 90 0250.

* cited by examiner

REFRIGERATOR

CROSS-REFERENCE TO RELATED APPLICATION(S)

This application is based on and claims priority under 35 U.S.C. § 119 to Korean Patent Application No. 10-2018-0162947, filed on Dec. 17, 2018, in the Korean Intellectual Property Office, the disclosure of which is incorporated by reference herein in its entirety.

BACKGROUND

1. Field

The disclosure relates to a refrigerator having an improved rear structure of a door.

2. Description of Related Art

Generally, a refrigerator is an appliance including a storage compartment for storing food and a cold air supply device for supplying cold air to the storage compartment, thereby storing the food in a fresh state. The storage compartment has an opened front surface to receive and withdraw food, and the opened front surface may be opened and closed by a door.

The refrigerator may include a dispenser to take drinking water from a front side of the door, an ice making device to make ice, and a water supply device to supply water to the dispenser or the ice making device.

The water supply device may include a filter to purify water supplied from an external water supply source, and a water tank to store the water purified by the filter and supply the purified water to the dispenser by a user's manipulation.

In general, the refrigerator may include a structure in which the water purified through the filter disposed in the storage compartment is stored in the water tank and then supplied to a dispenser provided in the door.

Therefore, because a water supply path from the filter to the water tank or a water supply path from the water tank to the dispenser is long, when water is not taken out from the dispenser for a long time, water present in a water supply hose may be deteriorated, or scale may occur inside the water supply hose, causing hygiene problems.

The filter may include a carbon block and the like capable of adsorbing foreign substances therein, and as the filter is used, foreign substances filtered out from the water may be gradually accumulated in the filter. Therefore, the function of the filter may be gradually degraded, so that the filter needs to be replaced after a certain period of time.

However, when the water tank and the filter are disposed in the storage compartment, it may be difficult for the user to replace or clean the water tank and the filter.

On the other hand, when the ice making device is disposed in the door instead of the storage compartment, two of the water hoses need to be provided to feed water to the dispenser and ice making device through a hinge, which may complicate a hinge configuration.

SUMMARY

It is an aspect of the disclosure to provide a refrigerator improved such that a water tank and a filter are disposed on a rear surface of a door rather than inside a storage compartment.

It is another aspect of the disclosure to provide a refrigerator improved such that a user may easily replace and clean a water tank and a filter.

It is another aspect of the disclosure to provide a refrigerator improved such that a water supply line to supply water to a dispenser or ice making device is simplified.

Additional aspects of the disclosure will be set forth in part in the description which follows and, in part, will be obvious from the description, or may be learned by practice of the disclosure.

In accordance with an aspect of the disclosure, a refrigerator includes a main body including a storage compartment, a door rotatably coupled to the main body to open and close the storage compartment, a dispenser provided on a front surface of the door, a case mounted on a rear surface of the door and accommodating a water tank disposed adjacent to the dispenser to store water supplied to the dispenser, and a filter including a filter body disposed below the water tank in a transverse direction, and a filter handle configured to allow the filter body to be inserted or withdrawn through an inner side surface of the door from the inside of the case.

The refrigerator may further include a filler rotatably provided on the door to prevent cold air in the storage compartment from leaking to the outside, and at least a portion of the filter handle exposed to the inner side surface of the door may be covered by the filler.

The water tank may be disposed in a longitudinal direction along one side of the dispenser.

The case may include a case hole provided at a lower portion of the inner side surface of the door, and the filter may be inserted or withdrawn in a transverse direction through the case hole.

The refrigerator may further include a tray disposed below the filter to store water dripping from the filter.

The tray may be disposed inside the case to be inserted or withdrawn through the case hole.

The case may include a guide portion provided adjacent to the case hole to guide the tray along the case hole, a rail portion provided adjacent to a bottom of the case to dispose the tray below the filter, and a support portion provided on an upper side of the rail portion to prevent the tray from being separated from the rail portion.

The tray may include a tray body configured to store water dripping from the filter, and protrusions protruding from opposite sides of the tray body to guide the tray along the rail portion.

The protrusions may be positioned between the rail portion and the support portion.

The water tank may include a tank end portion disposed on one side of the filter and recessed to correspond to a shape of the filter body.

The water tank may include a water outlet provided on an opposite side of the tank end portion to supply water from the water tank to the dispenser, a water inlet provided below the water outlet to introduce the water purified by the filter into the water tank, and a guide pipe extending from the water inlet to the inside of the water tank to guide water introduced into the water tank along the water inlet.

The refrigerator may further include an ice making device provided on the door to be disposed above the dispenser, and a valve disposed inside the case to supply the water purified by the filter to the water tank or the ice making device.

The door may include an inner door rotatably coupled to the main body and an outer door rotatably coupled to the inner door, and the ice making device may be provided on a front surface of the inner door to be opened and closed by the outer door.

The refrigerator may further include a hinge provided at an upper portion of the door to allow the door to be rotatably coupled to the main body and a raw water supply pipe configured to supply water to the filter from an external water supply source through the hinge, and the filter may further include a head portion detachably provided from the filter body and disposed adjacent to an outer side surface of the door.

The valve may be disposed above the filter and at a side portion of the water tank.

In accordance with another aspect of the disclosure, a refrigerator includes a main body including a storage compartment, a door rotatably coupled to the main body to open and close the storage compartment, a dispenser provided on a front surface of the door, and a water supply device provided on a rear surface of the door to supply water to the dispenser, wherein the water supply device includes a case mounted on the rear surface of the door, a water tank disposed inside the case adjacent to a side portion of the dispenser to store the water supplied to the dispenser, a filter disposed below the water tank to purify the water supplied to the water tank, and a valve disposed above the filter and at a side portion of the water tank to supply the water from the filter to the water tank.

The case may include a case hole provided on an inner side surface of the door, and the filter may be disposed in a transverse direction to be inserted or withdrawn in the transverse direction through the case hole from the inside of the case.

The water tank may be disposed in a longitudinal direction along one side of the case.

In accordance with another aspect of the disclosure, a refrigerator includes a main body including a storage compartment, a door rotatably coupled to the main body to open and close the storage compartment, a filler rotatably provided on the door to prevent cold air in the storage compartment from leaking to the outside, a dispenser provided on a front surface of the door, an ice making device provided on the door to be disposed above the dispenser, a water tank disposed along a longitudinal direction on a rear surface of the door to store water supplied to the dispenser, and a filter disposed in a transverse direction on the rear surface of the door to purify the water supplied to the water tank or the ice making device, wherein the filler is configured to cover at least a portion of the filter exposed to an inner side surface of the door.

The refrigerator may further include a tray disposed below the filter to store water dripping from the filter.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
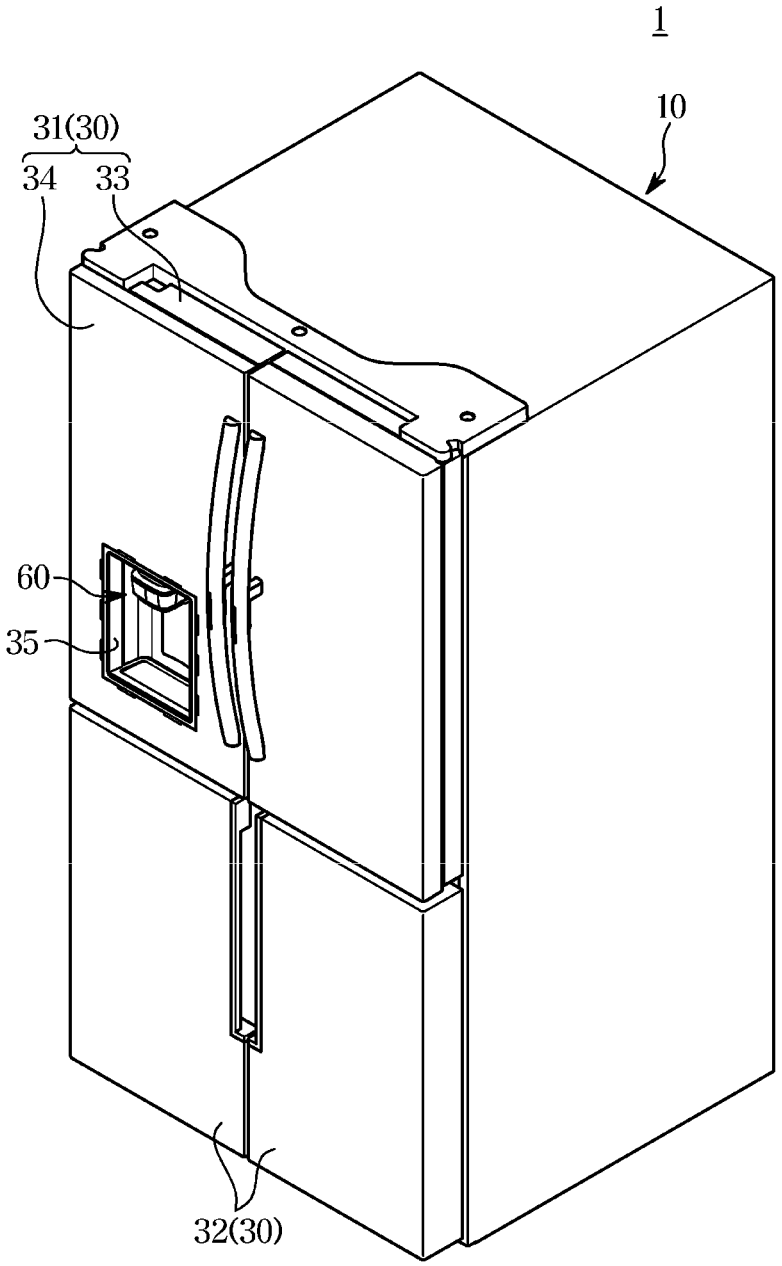
FIG. 1 is a perspective view of a refrigerator according to an embodiment of the disclosure.

The embodiments described herein and the configurations shown in the drawings are only examples of preferred embodiments of the disclosure, and various modifications may be made at the time of filing of the disclosure to replace the embodiments and drawings of the present specification.

Like reference numbers or signs in the various figures of the application represent parts and components that perform substantially the same functions.

The terms used herein are for the purpose of describing the embodiments and are not intended to restrict and/or to limit the disclosure. For example, the singular expressions herein may include plural expressions, unless the context clearly dictates otherwise.

The terms "comprises" or "has" are intended to indicate that there are features, numbers, steps, operations, elements, parts, or components thereof described in the specification, and do not exclude the presence or addition of one or more other features, numbers, steps, operations, elements, parts, or components thereof.

It will be understood that although the terms first, second, etc. may be used herein to describe various components, these components should not be limited by these terms, and the terms are only used to distinguish one component from another.

For example, without departing from the scope of the present invention, the first component may be referred to as a second component, and similarly, the second component may also be referred to as a first component. The term "and/or" includes any combination of a plurality of related items or any one of a plurality of related items.

In this specification, the terms "front," "rear," "upper," "lower," "left," and "right" are defined with reference to the drawings, and the shape and position of each component are not limited by these terms.

Hereinafter embodiments of the disclosure will be described in detail with reference to the accompanying drawings.

Figure 2:
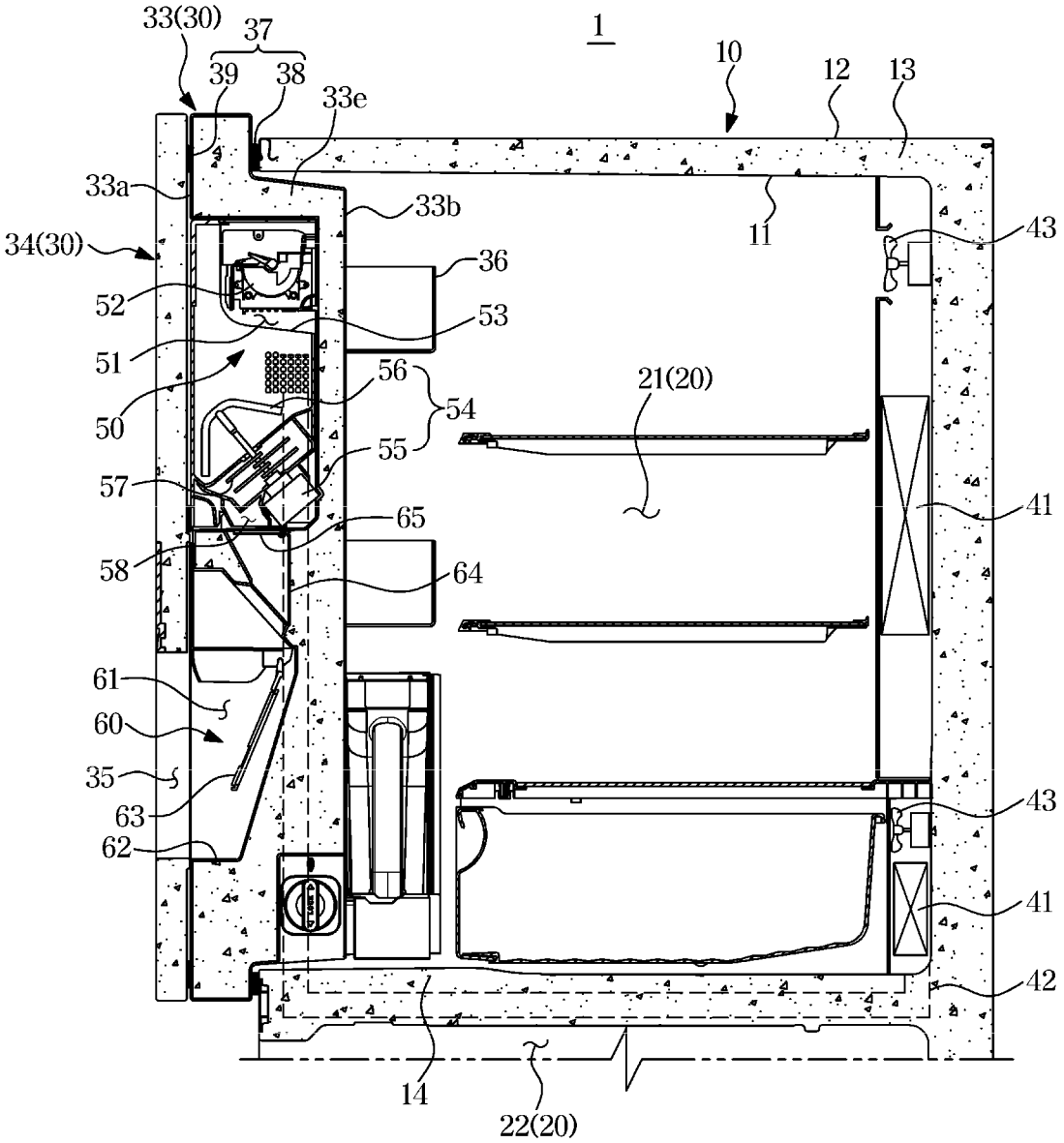
FIG. 2 is a schematic side cross-sectional view of the refrigerator according to an embodiment of the disclosure.
Figure 3:
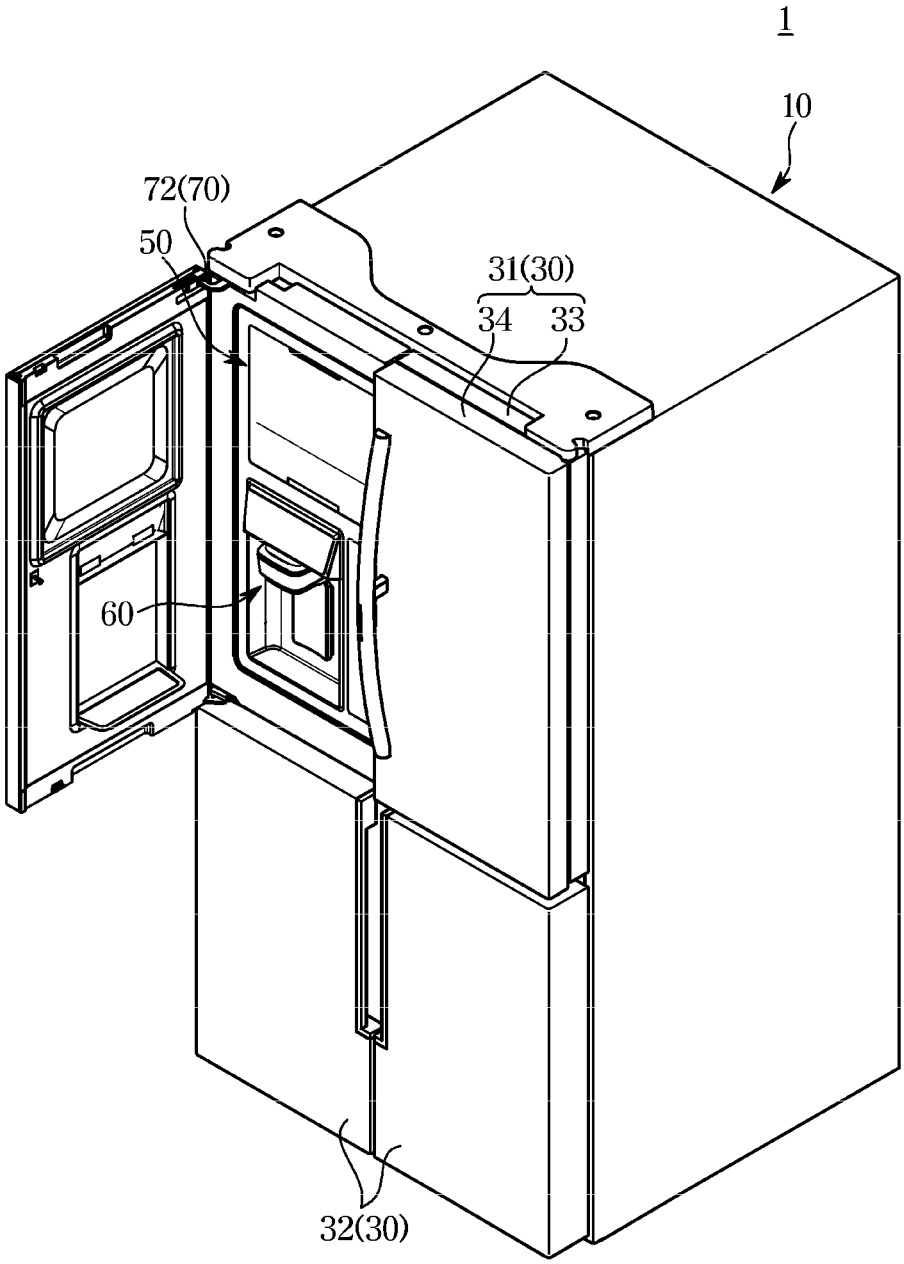
FIG. 3 is a view illustrating a state in which an outer door is opened in the refrigerator according to an embodiment of the disclosure.

FIG. 1 is a perspective view of a refrigerator according to an embodiment of the disclosure, FIG. 2 is a schematic side cross-sectional view of the refrigerator according to an embodiment of the disclosure, and FIG. 3 is a view illustrating a state in which an outer door is opened in the refrigerator according to an embodiment of the disclosure.

As illustrated in FIGS. 1 to 3, a refrigerator 1 may include a main body 10 including a storage compartment 20 and a door 30 provided in the front of the storage compartment 20. The refrigerator 1 may include a cold air supply device configured to supply cold air to the storage compartment 20.

The cold air supply device may include an evaporator 41, a compressor (not shown), a condenser (not shown), and an expansion device (not shown), and may generate cold air by using evaporative latent heat of a refrigerant.

The refrigerator 1 may include an ice making device 50 provided on the door 30 to make and store ice.

The cold air generated by the evaporator 41 may be supplied to the storage compartment 20 and the ice making device 50 by the operation of the blower fan 43. The refrigerator 1 may include a cold air duct 42 connecting the evaporator 41 to the ice making device 50 to supply the cold air generated by the evaporator 41 to the ice making device 50.

The main body 10 may include an inner case 11 forming the storage compartment 20 and an outer case 12 coupled to an outer side of the inner case 12 and forming an appearance of the refrigerator 1. The main body 10 may include a heat insulator 13 provided between the inner case 11 and the outer case 12 to insulate the storage compartment 20.

The inner case 11 may be formed by injection molding of a plastic material, and the outer case 12 may be formed of a metal material. A urethane foam insulator may be used as the heat insulator 13, and a vacuum heat insulator (vacuum insulation panel) may be used together as needed.

The main body 10 may include a partition 14, and the storage compartment 20 may be divided into an upper storage chamber 21 and a lower storage chamber 22 by the partition 14. The partition 14 may include the heat insulator 13, whereby the upper storage chamber 21 and the lower storage chamber 22 may be insulated from each other.

The door 30 may include an upper door 31 rotatably coupled to the main body 10 to open and close the upper storage chamber 21, and a lower door 32 rotatably coupled to the main body 10 to open and close the lower storage chamber 22.

The upper door 31 may include an inner door 33 rotatably coupled to the main body 10 to open and close the upper storage chamber 21, and an outer door 34 rotatably coupled to the inner door 33 to open and close the inner door 33.

The upper storage chamber 21 may be used as a refrigerating chamber to keep food in a refrigerated state at about 0 to 5 degrees Celsius, and the lower storage chamber 22 may be used as a freezing chamber to keep food in a frozen state at about −30 to 0 degrees Celsius. However, the disclosure is not limited thereto.

The door 30 may be rotatably configured by the hinge 70. The hinge 70 may include a first hinge 71*a* (see FIG. 4) provided to allow the inner door 33 to be rotatably coupled to the main body 10, and a second hinge 72 provided to allow the outer door 34 to be rotatably coupled to the inner door 33.

The inner door 33 may include a dispenser 60 configured to provide water and ice to a user.

The dispenser 60 may include a dispensing space 61 formed to be recessed to receive water and ice, and a dispensing tray 62 provided to place a container such as a cup in the dispensing space 61. The dispenser 60 may be provided at a front surface of the inner door 33.

The ice making device 50 may be provided in the inner door 33 to be disposed above the dispenser 60. The ice making device 50 may be provided at the front surface of the inner door 33 to be opened and closed by the outer door 34.

The inner door 33 and the outer door 34 may be configured to be rotatable in the same direction. The outer door 34 may have a size corresponding to a size of the inner door 33.

Accordingly, when both the inner door 33 and the outer door 34 are closed, only the dispenser 60 of the inner door 33 may be exposed through an opening 35 of the outer door 34, and the other portion of the inner door 33 may be covered with the outer door 34 and not be exposed.

The ice making device 50 may be provided in the inner door 33. The ice making device 50 may be provided on the front surface of the inner door 33 to be partitioned, separated, and independent from the upper storage chamber 21 by the inner door 33.

The inner door 33 may include a front plate 33*a*, a rear plate 33*b* coupled to the rear of the front plate 33*a*, an inner side plate 33*c* (see FIG. 4) and an outer side plate 33*d* (see FIG. 4) to connect the front plate 33*a* to the rear plate 33*b*, and a door heat insulator 33*e* provided between the front plate 33*a* and the rear plate 33*b*.

The ice making device 50 may be mounted in an ice making chamber 51 which is a space formed by recessing a partial region of the front plate 33*a* toward the door heat insulator 33*e*. The ice making chamber 51 may be configured such that a front surface thereof is opened. The opened front surface of the ice making chamber 51 may be opened and closed by an outer door 34.

Like the heat insulator 13 of the main body 10, a urethane foam heat insulator may be used as the door heat insulator 33*e*, and a vacuum heat insulator (vacuum insulation panel) may be used together as needed. The ice making chamber 51 may be insulated from the upper storage chamber 21 by the door heat insulator 33*e*.

The ice making device 50 capable of making, storing, and transferring ice may be disposed in the ice making chamber 51. The ice making device 50 may include an ice maker 52 to make ice by receiving and cooling water, and an ice bucket 53 to store ice made in the ice maker 52.

The ice making device 50 may include a transfer device 54 to transfer the ice stored in the ice bucket 53 to the dispenser 60, and an ice crushing blade 57 provided to crush the ice.

The transfer device 54 may include an auger motor 55 to generate a rotational force, and a transfer member 56 to receive power from the auger motor 55 and rotate to stir or transfer the ice.

The ice maker 52 may include an ice-making shell (not shown) in which water is received, and an ejector (not shown) configured to transfer the ice made in the ice-making shell to the ice bucket 53.

The ice making device 50 may include an ice sensor (not shown) to detect a full ice level in the ice bucket 53 and may be configured to automatically perform a series of operations such as water supply, cooling, ice separating, detection of the full ice level, stirring and crushing.

The transfer device 54 and the ice crushing blade 57 may be integrally provided in the ice bucket 53. A lower portion of the ice bucket 53 may be formed with a discharge port 58 to discharge the stored ice to a chute 64.

The user may take out the ice bucket 53 by opening only the outer door 34, without opening the inner door 33, and accessing the ice making chamber 51.

Therefore, the operation of taking out the ice from the ice bucket 53, or the works of repairing, cleaning and replacing the ice bucket 53, the auger motor 55, the transfer member 56, and the ice crushing blade 57 may be easily performed.

In addition, because the inner door 33 may be maintained in a closed state when the user accesses the ice making chamber 51, outflow of cold air in the upper storage chamber 21 may be prevented and energy may be saved.

The dispenser 60 may include a switch 63 to input an operation command of the dispenser 60.

The inner door 33 may include the chute 64 connecting the ice making chamber 51 to the dispensing space 61 to guide the ice in the ice bucket 53 to the dispensing space 61.

An opening and closing member 65, which closes the chute 64 in a normal state to prevent the cold air in the ice making chamber 51 from leaking to the outside through the chute 64 and opens the chute 64 to allow ice to pass when the dispenser 60 operates, may be provided inside the chute 64.

The outer door 34 may have the opening 35 to allow access to the dispenser 60 of the inner door 33 with the outer door 34 closed. The opening 35 may be formed at a position corresponding to the dispenser 60. The opening 35 may have a substantially rectangular shape.

A door guard 36 to store food may be provided on a rear surface of the inner door 33. A gasket 37 in close contact with a front surface of the main body 10 may be provided on a rear surface of the upper door 31 to seal the upper storage chamber 21.

The gasket 37 may include a first gasket 38 in close contact with the rear surface of the inner door 33 and the front surface of the main body 10 to seal the upper storage chamber 21, and a second gasket 39 in close contact with a rear surface of the outer door 34 and the front surface of the inner door 33 to seal the ice making chamber 51.

Figure 4:
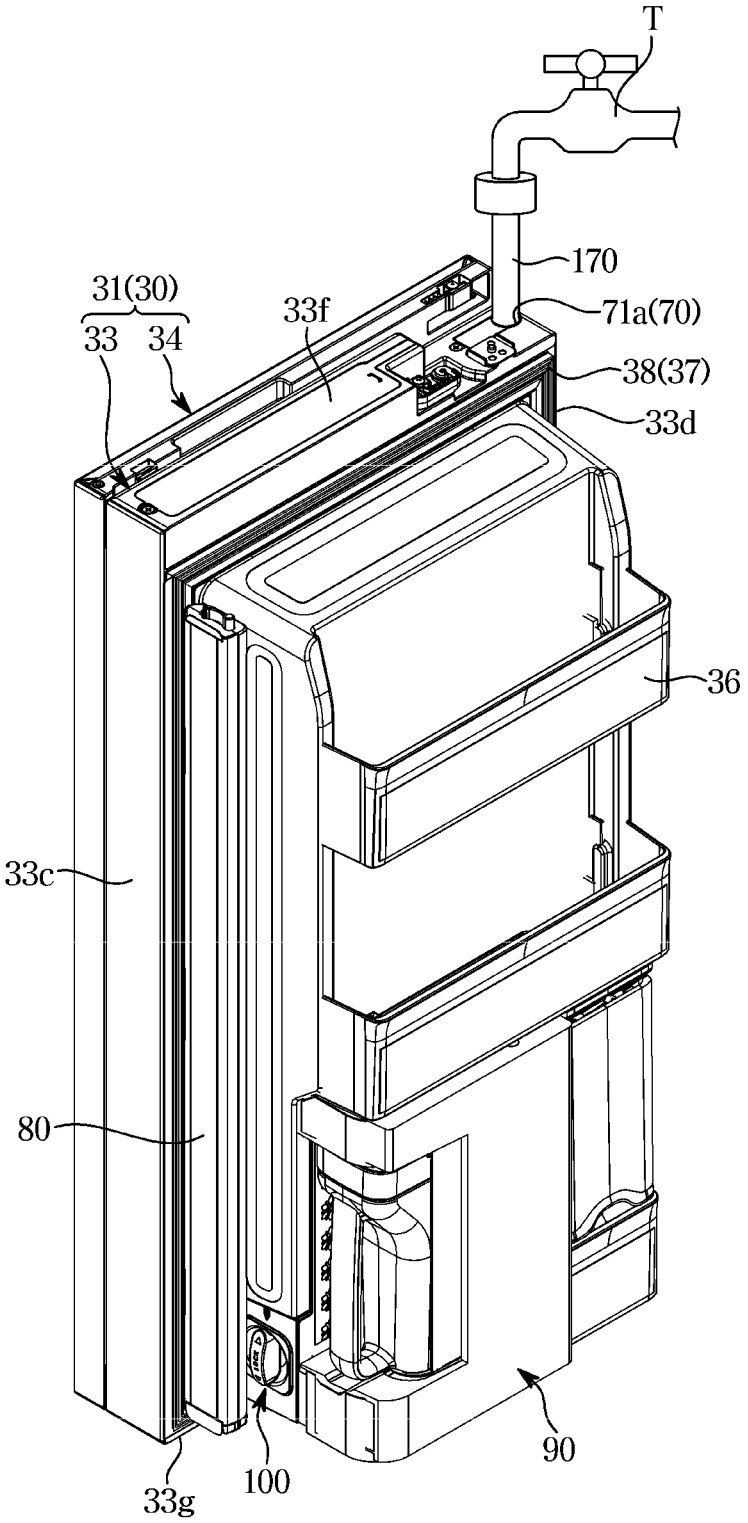
FIG. 4 is a view illustrating a rear surface of an inner door in the refrigerator according to an embodiment of the disclosure.
Figure 5:
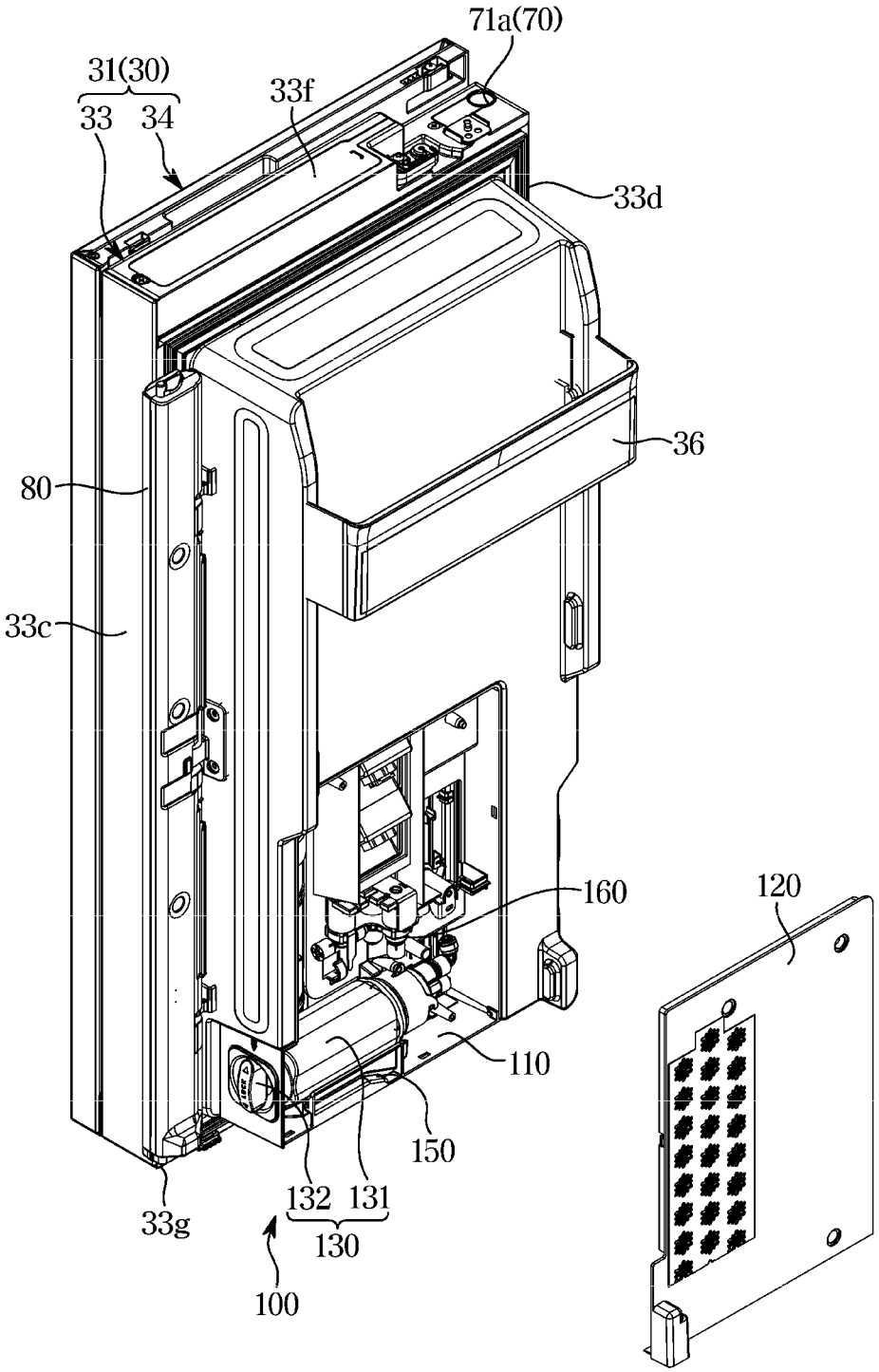
FIG. 5 is a view illustrating a state in which a cover of a water supply device is separated in the refrigerator according to an embodiment of the disclosure.
Figure 6:
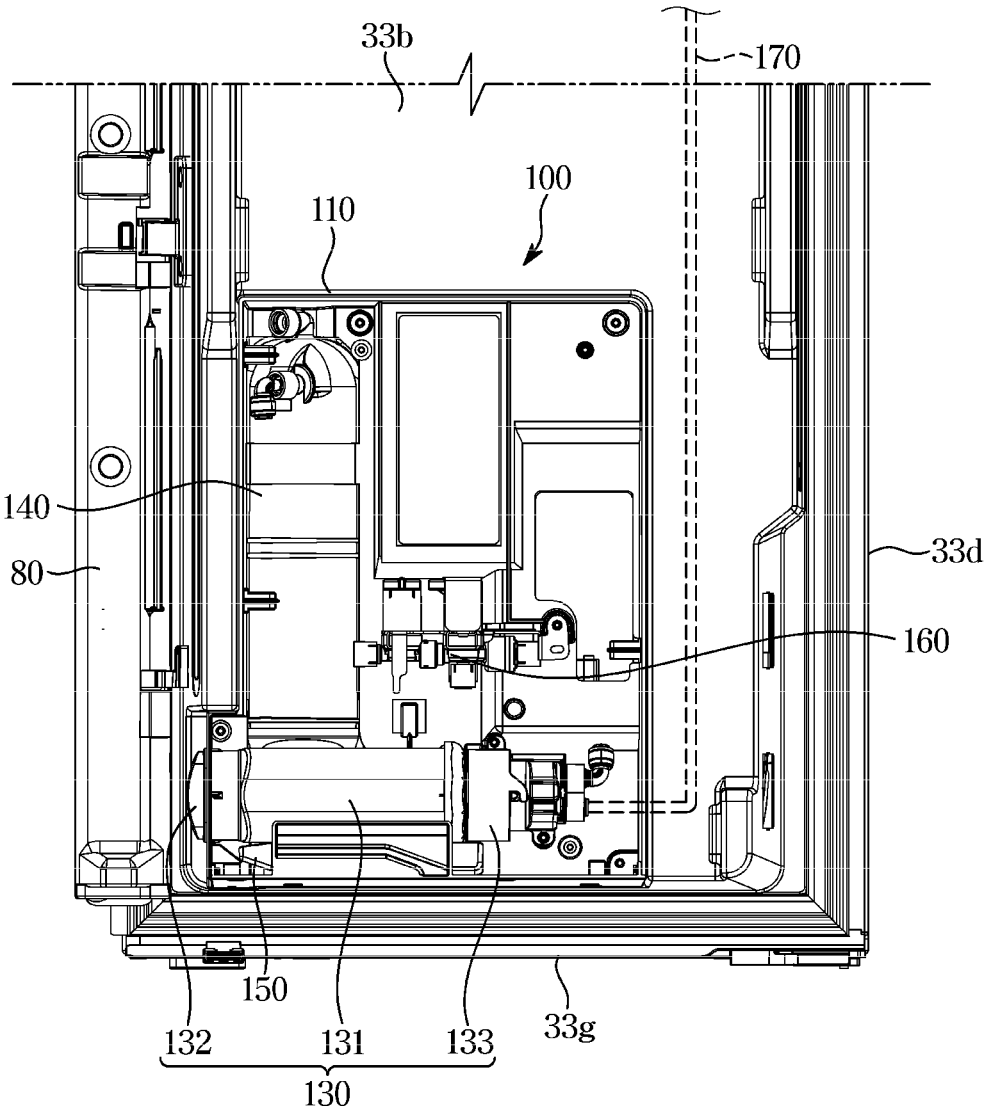
FIG. 6 is a view illustrating the water supply device mounted on the rear surface of the inner door in the refrigerator according to an embodiment of the disclosure.

FIG. 4 is a view illustrating the rear surface of the inner door in the refrigerator according to an embodiment of the disclosure, FIG. 5 is a view illustrating a state in which a cover of a water supply device is separated in the refrigerator according to an embodiment of the disclosure, and FIG. 6 is a view illustrating the water supply device mounted on the rear surface of the inner door in the refrigerator according to an embodiment of the disclosure.

As illustrated in FIGS. 4 to 6, the refrigerator 1 (see FIG. 1) may include a water supply device 100 to supply water to the ice making device 50 (see FIG. 2) or the dispenser 60 (see FIG. 2).

The water supply device 100 may be provided at the rear surface of the inner door 33. The water supply device 100 may include a case 110 mounted on the rear surface of the inner door 33, and a water tank 140 disposed adjacent to the dispenser 60 to store water supplied to the dispenser 60. The water tank 140 may be disposed adjacent to a side portion of the dispenser 60.

Therefore, the refrigerator 1 according to an embodiment of the disclosure may minimize a water supply line between the water tank 140 and the dispenser 60. The water tank 140 may be disposed in a longitudinal direction along one side of the dispenser 60. The water tank 140 may be disposed in the longitudinal direction along one side of the case 110.

The water tank 140 may be disposed in parallel with the inner side plate 33*c* or the outer side plate 33*d* of the inner door 33.

The water tank 140 may be provided on the rear surface of the inner door 33 to communicate with the upper storage chamber 21 (see FIG. 2). Therefore, the cold air in the upper storage chamber 21 may be introduced into the water tank 140, and thus, the water stored in the water tank 140 may be cooled.

The water supply device 100 may include a cover 120 detachably coupled to the case 110 to cover the case 110.

The refrigerator 1 may include a water cup 90 provided on the rear surface of the inner door 33. The water supply device 100 may be disposed between the rear surface of the inner door 33 and the water cup 90.

The water supply device 100 may include a filter 130 disposed below the water tank 140 to purify the water supplied to the water tank 140. The filter 130 may be disposed inside the case 110 along a transverse direction.

The filter 130 may be disposed in parallel with an upper plate 33*f* or a lower plate 33*g* of the inner door 33.

The filter 130 may include a filter body 131 disposed in the transverse direction below the water tank 140, and a filter handle 132 to allow the filter body 131 to be inserted or withdrawn into or from the case 110 through an inner side surface of the inner door 33. The filter 130 may be inserted or withdrawn through the inner side plate 33*c* of the inner door 33.

The filter 130 may include a head portion 133 detachably coupled to the filter body 131 and disposed adjacent to an outer side surface of the inner door 33. The head portion 133 may be disposed adjacent to the outer side plate 33*d* of the inner door 33.

The refrigerator 1 may include the first hinge 71*a* provided at an upper portion of the inner door 33 to allow the inner door 33 to be rotatably coupled to the main body 10, and a raw water supply pipe 170 provided to supply water from an external water supply source T to the filter 130 through the first hinge 71*a*.

The first hinge 71*a* may be disposed at one end of the upper plate 33*f* adjacent to the outer side plate 33*d* of the inner door 33, and the raw water supply pipe 170 may be inserted into the inner door 33 through the first hinge 71*a*. The raw water supply pipe 170 may be disposed adjacent to the outer side plate 33*d* of the inner door 33.

The raw water supply pipe 170 may be connected to the filter 130 mounted on the inner door 33 by passing through the door heat insulator 33*e* of the inner door 33.

Therefore, in the refrigerator 1 according to an embodiment of the disclosure, because the filter 130 is disposed along the transverse direction at the rear of the inner door 33, the head portion 133 of the filter 130 connected to the raw water supply pipe 170 may be disposed adjacent to the outer side plate 33*d* of the inner door 33, and the water supply line between the raw water supply pipe 170 and the head portion 133 may be minimized.

The refrigerator 1 may include a purified water supply pipe (not shown) to guide water purified through the filter 130 to the water tank 140 or the ice making device 50.

The water supply device 100 may include a valve 160 to supply water from the filter 130 to the water tank 140 or the ice making device 50. The valve 160 may be connected to the filter 130. The valve 160 may be connected to the purified water supply pipe.

Raw water introduced into the filter 130 through the raw water supply pipe 170 may be purified through the filter 130 and then may be supplied to the water tank 140 or the ice making device 50 along the purified water supply pipe through the valve 160 connected to the filter 130.

Therefore, in the refrigerator 1 according to an embodiment of the disclosure, because both the ice making device 50 and the dispenser 60 are provided in the inner door 33, the purified water supply pipe may be installed only in the inner door 33, and does not need to extend to the main body 10. Thus, the water supply line may be simpler, and the connection of the water supply pipe may be easier.

That is, the purified water supply pipe does not need to penetrate the dispenser 60 and the ice making device 50 through the first hinge 71*a*, respectively, only the raw water supply pipe 170 may be inserted through the first hinge 71*a*, and the purified water supply pipe may be connected to the dispenser 60 and the ice making device 50 in the inside of the inner door 33 irrespective of the first hinge 71*a*.

The valve 160 may be disposed above the filter 130. The valve 160 may be disposed at a side portion of the water tank 140. The valve 160 may be accommodated in the case 110 to be disposed in the rear of the dispenser 60.

Therefore, in the refrigerator 1 according to an embodiment of the disclosure, the filter 130, the water tank 140, and the valve 160 may be disposed in a space formed by the case 110 and the cover 120 to form an assembly, and the entire water supply device 100 is mounted on the rear plate 33*b* of the inner door 33 so that a storage space of the storage compartment 20 may be enlarged.

The case 110 may include a case hole 111 into which the filter 130 is inserted. The case hole 111 may be provided at a lower portion of the inner side plate 33*c* of the inner door 30.

The filter 130 may be rotated and coupled in a state of being inserted into the case hole 111.

The filter 130 may include an internal filter (not shown) to filter out foreign substances contained in water, and the filter body 131 to accommodate the internal filter. The filter 130 may include the head portion 133 configured to cover one side of the filter body 131.

The filter body 131 may form an appearance of the filter 130. The filter body 131 may be formed in a rectangular tubular shape having a predetermined length.

When the filter body 131 is formed in a rectangular tubular shape, even if the filter 130 falls and collides with the ground due to a mistake of the user, the collision with the ground is likely to occur at an edge of the filter body 131.

However, the disclosure is not limited thereto, and the filter body 131 may be formed in a polygonal tubular shape in addition to the rectangular tubular shape, and may be formed in an elliptical tubular shape or a tubular shape in which a plane and a curved surface are combined.

The filter 130 may include the filter handle 132 provided at one side of the filter body 131 to allow the user to grasp the filter handle 132 and apply a force to the filter 130.

The filter handle 132 and the head portion 133 may be formed in a rectangular shape to correspond to the case hole 111. The filter body 131, the filter handle 132, and the head portion 133 may be integrally formed in the process of injection molding the filter 130.

However, the disclosure is not limited thereto, and the filter handle 132 and the filter body 131 may be manufactured separately and then the filter handle 132 may be fixed to the filter body 131 to form the filter handle 132 on the filter body 131.

Because the case hole 111 is formed in a rectangular shape and the filter handle 132 and the filter body 131 are formed in a rectangular shape, while the filter 130 passes through the case hole 111, the user may not rotate the filter 130. Therefore, a portion between the filter body 131 and the filter handle 132 may be formed in a cylindrical shape to allow the filter 130 to be rotated.

The refrigerator 1 may include a filler 80 rotatably provided on the inner door 33 to prevent cold air in the storage compartment 20 from leaking to the outside. The filler 80 may cover at least a portion of the filter handle 132 exposed to the inner side surface of the inner door 33.

Therefore, in the refrigerator 1 according to an embodiment of the disclosure, the pillar 80 is disposed in parallel with the inner side plate 33*c* of the inner door 33 when the door 30 is opened, so that a portion of the filter handle 132 exposed to the outside through the case hole 111 may be concealed by the filler 80.

The water supply device 100 may include a tray 150 disposed below the filter 130 to store water dripping from the filter 130. The tray 150 may be disposed at a bottom of the case 110.

Therefore, the refrigerator 1 according to an embodiment of the disclosure includes the tray 150 detachably disposed below the filter 130 because water may drip from the filter 130 in the process of replacing the filter 130, so that water dripping from the filter 130 may be prevented from leaking to the inside of the inner door 33.

Figure 7:
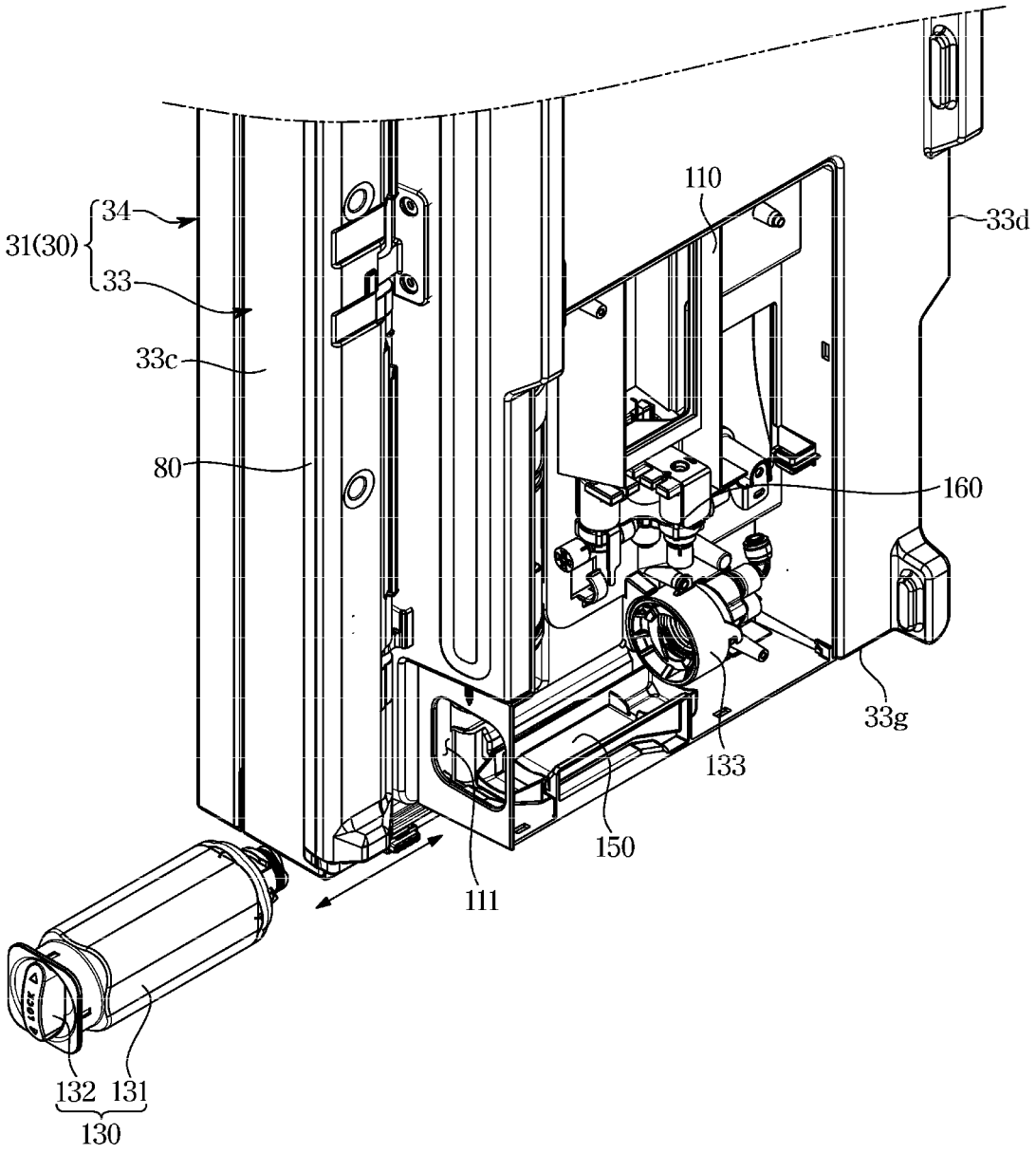
FIG. 7 is a view illustrating a state in which a filter is separated from a case in the refrigerator according to an embodiment of the disclosure.
Figure 8:
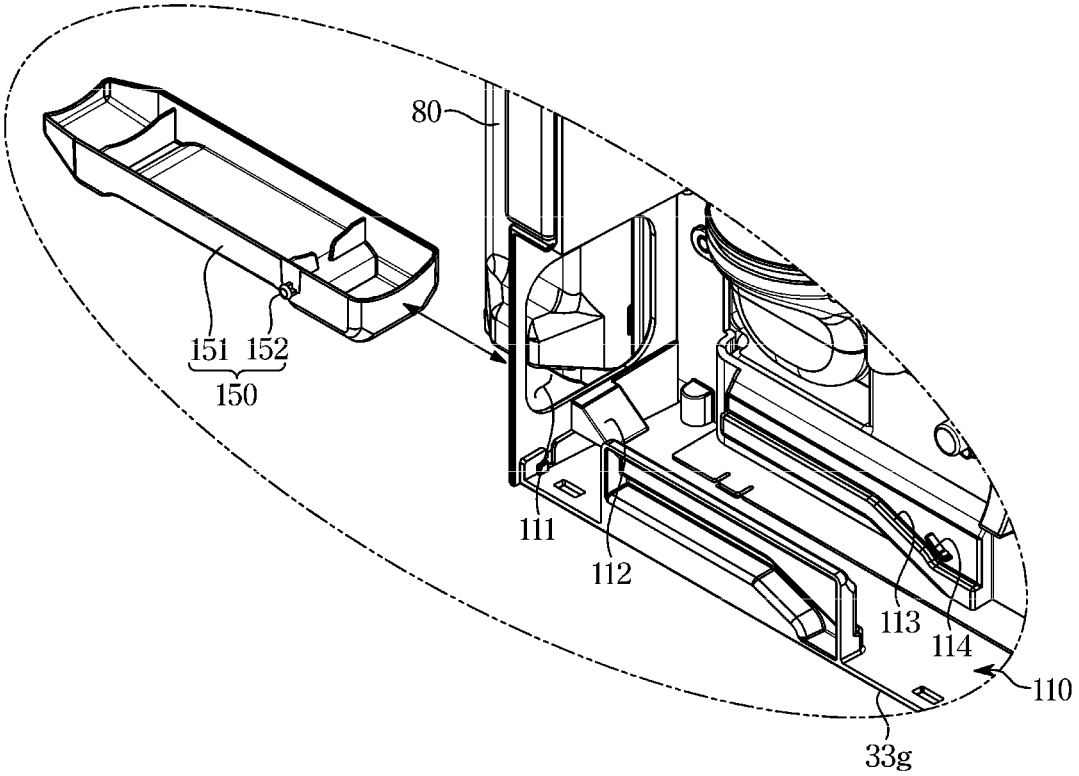
FIG. 8 is an enlarged view illustrating a state in which a tray is separated from the case in the refrigerator according to an embodiment of the disclosure.

FIG. 7 is a view illustrating a state in which the filter is separated from the case in the refrigerator according to an embodiment of the disclosure, and FIG. 8 is an enlarged view illustrating a state in which the tray is separated from the case in the refrigerator according to an embodiment of the disclosure.

As illustrated in FIGS. 7 and 8, the filter 130 may be inserted or withdrawn in the transverse direction through the case hole 111.

A portion of the filter 130 may be covered by the filler 80 when the inner door 33 is opened, and the user may rotate the filler 80 to expose the filter 130 to the outside when the filter 130 needs to be replaced, so that the user may grasp the filter handle 132 without the interference of the filler 80 and insert or withdraw the filter 130 through the case hole 111.

The tray 150 may be disposed inside the case 110 to be inserted or withdrawn through the case hole 111. The tray 150 may be detachably provided to remove water that dripping from the filter 130 and stored in the tray 150.

The user may withdraw the filter 130 from the case hole 111 and then withdraw the tray 150 through the case hole 111, so that the water stored in the tray 150 may be removed.

The case 110 may include a guide portion 112 provided adjacent to the case hole 111 to guide the tray 150 along the case hole 111, and a rail portion 113 provided adjacent to the bottom of the case 110 to dispose the tray 150 below the filter 130.

The guide portion 112 may include an inclination. The guide portion 112 may connect the case hole 111 to the bottom of the case 110. However, the disclosure is not limited thereto.

Two of the rail portions 113 may be provided at opposite sides adjacent to the bottom of the case 11. However, the disclosure is not limited thereto.

The case 110 may include a support portion 114 provided on an upper side of the rail portion 113 to prevent the tray 150 from being separated from the rail portion 113. The support portion 114 may be provided to protrude from the rail portion 113. Two of the support portions 114 may be provided on two of the rail portions 113, respectively. However, the disclosure is not limited thereto.

The tray 150 may include a tray body 151 to store water dripping from the filter 130, and protrusions 152 protruding from opposite sides of the tray body 151 to guide the tray 150 along the rail portion 113.

The protrusion 152 may be provided at a rear portion of the tray body 151. Two of the protrusions 152 may be provided. However, the disclosure is not limited thereto.

The protrusion 152 may be positioned between the rail portion 113 and the support portion 114. The protrusion 152 may be disposed above the rail portion 113 and may be disposed below the support portion 114.

Figure 9:
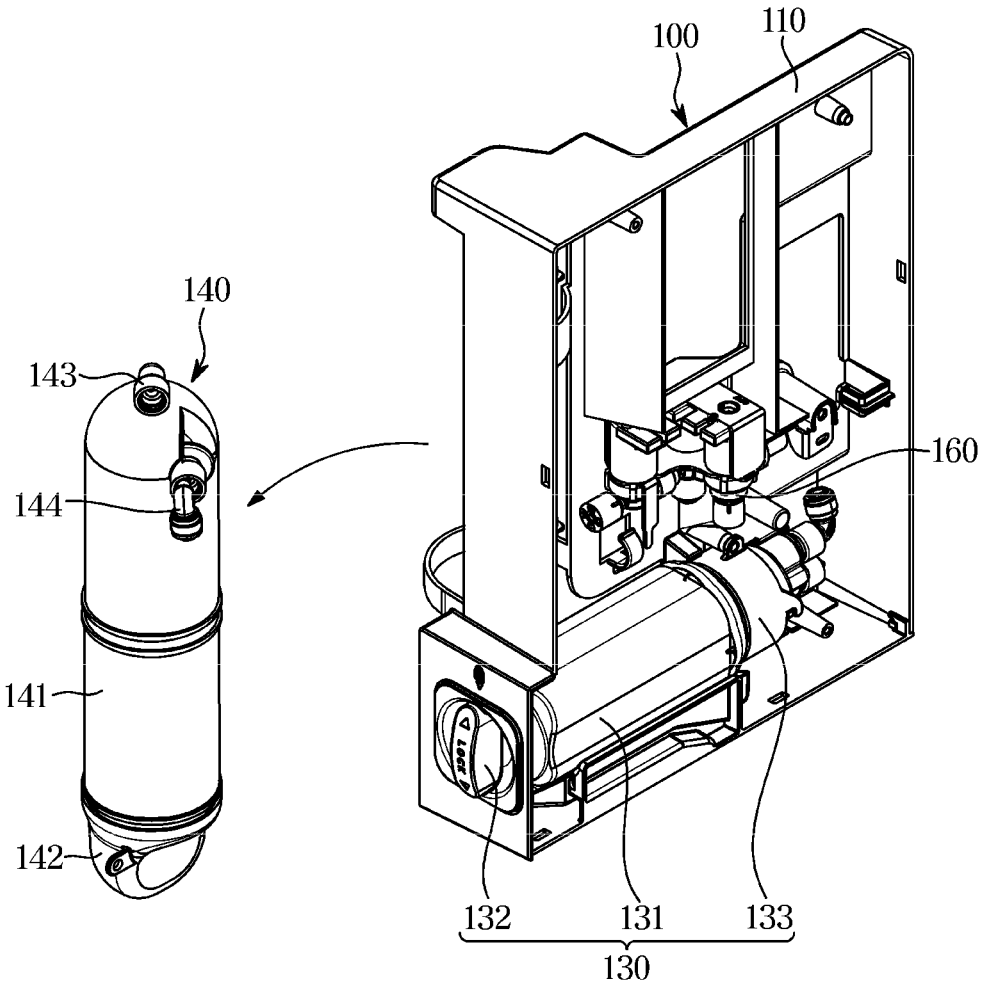
FIG. 9 is a view illustrating a state in which a water tank is separated from the case in the refrigerator according to an embodiment of the disclosure.
Figure 10:
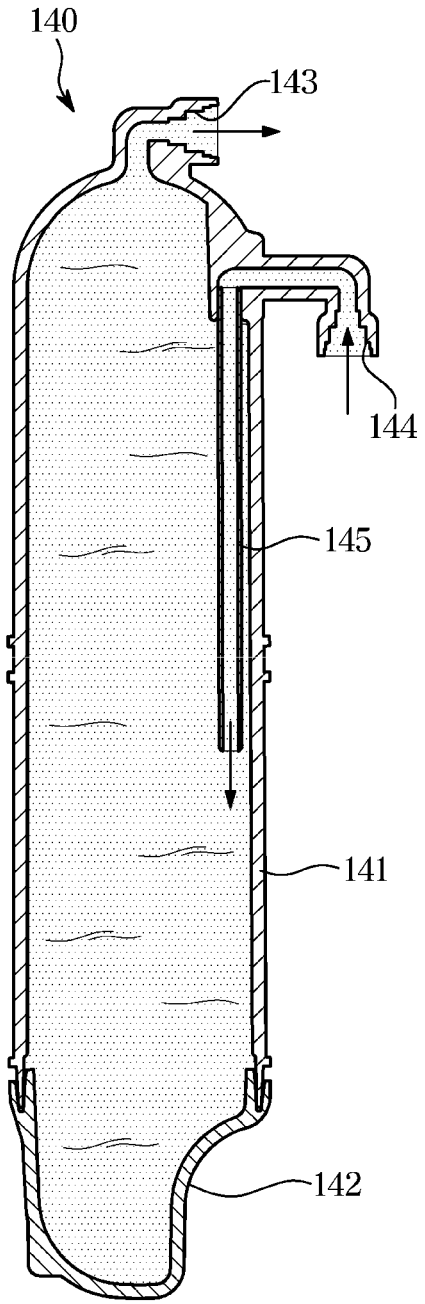
FIG. 10 is a view illustrating a guide pipe provided inside the water tank in the refrigerator according to an embodiment of the disclosure.

FIG. 9 is a view illustrating a state in which the water tank is separated from the case in the refrigerator according to an embodiment of the disclosure, and FIG. 10 is a view illustrating a guide pipe provided inside the water tank in the refrigerator according to an embodiment of the disclosure.

As illustrated in FIGS. 9 and 10, the water tank 140 may be detachably provided in the case 110, and the user may separate the water tank 140 from the case 110 and clean or replace the water tank 140.

The water tank 140 may include a tank body 141 to store water introduced from the filter 130, and a tank end portion 142 disposed at one side of the filter 130 and recessed to correspond to the shape of the filter body 131.

The tank end portion 142 may include a groove to be disposed at one side of the filter 130.

Therefore, in the refrigerator 1 according to an embodiment of the disclosure, because the water tank 140 and the filter 130 may be disposed inside the case 110 to partially overlap, the volume of a space occupied by the water supply device 100 may be minimized.

The tank body 141 and the tank end portion 142 may be coupled to be disassemble and assemble so that the user may clean. Therefore, because the user may easily clean the inside of the tank body 141 by separating the tank end portion 142 of the water tank 140, the water tank 140 may be always maintained in a sanitary state so that safe water may be supplied to the user.

The water tank 140 may include a water outlet 143 provided on an opposite side of the tank end portion 142 to supply water from the water tank 140 to the dispenser 60, and a water inlet 144 to introduce the purified water from the filter 130 into the water tank 140.

The water inlet 144 may be connected to the valve 160, and the water outlet 143 may be connected to the dispenser 60.

The water inlet 144 may be disposed below the water outlet 143. However, the disclosure is not limited thereto.

The water tank 140 may include a guide pipe 145 extending from the water inlet 144 and disposed inside the water tank 140 to guide the water introduced into the water tank 140 along the water inlet 144.

The guide pipe 145 may extend from the water inlet 144 toward a lower portion of the tank body 141. The guide pipe 145 may be formed in a cylindrical shape with a hollow portion. However, the disclosure is not limited thereto.

Therefore, because the refrigerator 1 according to an embodiment of the disclosure includes the guide pipe 145, water that is purified from the filter 130 and introduced into the tank body 141 through the water inlet 144 may be prevented from being immediately discharged to the dispenser 60 through the water outlet 143.

That is, because the water introduced into the tank body 141 through the water inlet 144 may be guided to the lower portion of the tank body 141 through the guide pipe 145 to be accommodated in the tank body 141 and the cooled water stored in the upper portion of the tank body 141 may be discharged first through the water outlet 143, the user may take out the cooled water through the dispenser 60.

As is apparent from the above, according to an embodiment of the disclosure, because a water tank and a filter to supply water to a dispenser or ice making device are disposed on a rear surface of a door, a water supply line connecting the dispenser to the water tank can be simplified.

According to an embodiment of the disclosure, because the water tank and the filter are disposed on the rear surface of the door, a storage space of a storage compartment can be increased.

According to an embodiment of the disclosure, because the water tank and the filter are detachably mounted on the rear surface of the door, a user can easily clean and replace the water tank and the filter.

The foregoing has illustrated and described specific embodiments. However, it should be understood that the disclosure is not limited to the above-described embodiments, and various changes and modifications may be made without departing from the technical idea of the disclosure described in the following claims.

What is claimed is:

1. A refrigerator comprising:

a main body including a storage compartment;

a door rotatably coupled to the main body to open and close the storage compartment;

a dispenser provided on a front surface of the door;

a case mounted on a rear surface of the door and accommodating a water tank to store water supplied to the dispenser; and a filter including a filter body, and a filter handle configured to allow the filter body to be inserted through an inner side surface of the door into the case so as to be disposed in a transverse direction in the case, and to allow the filter body to be withdrawn from the case through the inner side surface of the door.

2. The refrigerator according to claim 1, further comprising a filler rotatably provided on the door to prevent cold air in the storage compartment from leaking to the outside, wherein, when the filter body is disposed in the case, at least a portion of the filter handle exposed to the inner side surface of the door is covered by the filler.

3. The refrigerator according to claim 1, wherein the water tank is disposed in a longitudinal direction along one side of the dispenser.

4. The refrigerator according to claim 1, wherein the case includes a case hole provided at a lower portion of the inner side surface of the door, and the filter body is inserted or withdrawn through the case hole.

5. The refrigerator according to claim 4, further comprising:

a tray that, when the filter body is disposed in the case, is disposed below the filter to store water dripping from the filter.

6. The refrigerator according to claim 5, wherein the tray is disposed inside the case to be inserted or withdrawn through the case hole.

7. The refrigerator according to claim 5, wherein the case includes:

a guide portion provided adjacent to the case hole to guide the tray along the case hole, a rail portion provided adjacent to a bottom of the case to dispose the tray below the filter, and a support portion provided on an upper side of the rail portion to prevent the tray from being separated from the rail portion.

8. The refrigerator according to claim 7, wherein the tray includes a tray body configured to store water dripping from the filter, and protrusions protruding from opposite sides of the tray body to guide the tray along the rail portion.

9. The refrigerator according to claim 8, wherein the protrusions are positioned between the rail portion and the support portion.

10. The refrigerator according to claim 1, wherein the water tank includes a tank end portion that, when the filter body is disposed in the case, is disposed on one side of the filter and recessed to correspond to a shape of the filter body.

11. The refrigerator according to claim 10, wherein the water tank includes:

a water outlet provided on an opposite side of the tank end portion to supply water from the water tank to the dispenser, a water inlet provided below the water outlet to introduce the water purified by the filter into the water tank, and a guide pipe extending from the water inlet to the inside of the water tank to guide water introduced into the water tank along the water inlet.

12. The refrigerator according to claim 1, further comprising:

an ice making device provided on the door to be disposed above the dispenser, and a valve disposed inside the case to supply the water purified by the filter to the water tank or the ice making device.

13. The refrigerator according to claim 12, wherein the door includes an inner door rotatably coupled to the main body and an outer door rotatably coupled to the inner door, and the ice making device is provided on a front surface of the inner door to be opened and closed by the outer door.

14. The refrigerator according to claim 1, further comprising:

a hinge provided at an upper portion of the door to allow the door to be rotatably coupled to the main body, and a raw water supply pipe configured to supply water to the filter from an external water supply source through the hinge, wherein the filter further includes a head portion detachably provided from the filter body and, when the filter body is disposed in the case, is disposed adjacent to an outer side surface of the door.

15. The refrigerator according to claim 12, wherein, when the filter body is disposed in the case, the valve is disposed above the filter and at a side portion of the water tank.

16. A refrigerator comprising:

a main body including a storage compartment;

a door rotatably coupled to the main body to open and close the storage compartment;

a dispenser provided on a front surface of the door; and a water supply device provided on a rear surface of the door to supply water to the dispenser, wherein the water supply device includes a case mounted on the rear surface of the door, a water tank disposed inside the case adjacent to a side portion of the dispenser to store the water supplied to the dispenser, a filter positionable below the water tank to purify the water supplied to the water tank, and a valve that, when the filter is positioned below the water tank, is disposed above the filter and at a side portion of the water tank to supply the water from the filter to the water tank.

17. The refrigerator according to claim 16, wherein the case includes a case hole provided on an inner side surface of the door, and the filter is insertable through the case hole into the case so as to be disposed in a transverse direction in the case and thereby be positioned below the water tank, and is withdrawable in the transverse direction from the case through the case hole.

18. The refrigerator according to claim 16, wherein the water tank is disposed in a longitudinal direction along one side of the case.

19. A refrigerator comprising:

a main body including a storage compartment;

a door rotatably coupled to the main body to open and close the storage compartment;

a filler rotatably provided on the door to prevent cold air in the storage compartment from leaking to the outside;

a dispenser provided on a front surface of the door;

an ice making device provided on the door to be disposed above the dispenser;

a water tank disposed along a longitudinal direction on a rear surface of the door to store water supplied to the dispenser; and a filter disposed in a transverse direction on the rear surface of the door to purify the water supplied to the water tank or the ice making device, wherein the filler is configured to cover at least a portion of the filter exposed to an inner side surface of the door.

20. The refrigerator according to claim 19, further comprising a tray disposed below the filter to store water dripping from the filter.

* * * * *